US007777699B2

(12) United States Patent
Varrin et al.

(10) Patent No.: US 7,777,699 B2
(45) Date of Patent: Aug. 17, 2010

(54) DISPLAY SYSTEM HAVING PIXELS

(75) Inventors: Christopher Varrin, Monte Sereno, CA (US); Nils Thorjussen, Palo Alto, CA (US); Matthew Ward, San Francisco, CA (US); Jeremy Hochman, Austin, TX (US); Jeff Maddox, Austin, TX (US); David Main, Boulder Creek, CA (US)

(73) Assignee: Barco, Inc., Duluth, GA (US)

( * ) Notice: Subject to any disclaimer, the term of this patent is extended or adjusted under 35 U.S.C. 154(b) by 770 days.

(21) Appl. No.: 11/740,668

(22) Filed: Apr. 26, 2007

(65) Prior Publication Data

US 2007/0279338 A1 Dec. 6, 2007

Related U.S. Application Data

(60) Provisional application No. 60/796,451, filed on May 1, 2006.

(51) Int. Cl.
*G09G 3/30* (2006.01)

(52) U.S. Cl. ..... 345/76; 345/77; 345/82; 345/84

(58) Field of Classification Search ..... 345/76–84, 345/204–215
See application file for complete search history.

(56) References Cited

U.S. PATENT DOCUMENTS

| | | | | |
|---|---|---|---|---|
| 6,237,918 | B1 | 5/2001 | Williams | |
| 6,314,669 | B1 | 11/2001 | Tucker | |
| 6,677,918 | B2 | 1/2004 | Yuhara et al. | |
| 6,704,989 | B1 | 3/2004 | Lutz et al. | |
| 6,813,853 | B1 | 11/2004 | Tucker | |
| 7,045,971 | B2 * | 5/2006 | Goto | 315/291 |
| 2005/0024877 | A1 * | 2/2005 | Frederick | 362/277 |
| 2005/0057942 | A1 * | 3/2005 | Mako et al. | 362/554 |
| 2005/0141237 | A1 | 6/2005 | Goto | |

FOREIGN PATENT DOCUMENTS

| | | |
|---|---|---|
| JP | 2003-162233 | 6/2003 |
| KR | 10-2005-0094919 | 9/2005 |
| KR | 10-2005-0095732 | 9/2005 |

OTHER PUBLICATIONS

International Search Report dated Oct. 18, 2007 (3 pages).
Written Opinion dated Oct. 18, 2007 (4 pages).

* cited by examiner

*Primary Examiner*—Vijay Shankar
(74) *Attorney, Agent, or Firm*—Aka Chan LLP

(57) ABSTRACT

A light emitting apparatus and a method of displaying an image therewith is disclosed. The light emitting apparatus includes a spine and a rib. The rib is attached to the spine and includes a plurality of alternating nodes and connection links. At least one of the connection links is thinner in cross-section than at least one of the nodes. The light emitting apparatus then further includes a connector to attach multiple light emitting apparatuses together. The light emitting apparatus further includes a plurality of pixels, in which the pixels are configured to receive a data signal and power.

15 Claims, 8 Drawing Sheets

DISPLAY SYSTEM HAVING PIXELS

CROSS-REFERENCE TO RELATED APPLICATIONS

This applications claims benefit, under 35 U.S.C. §119, of U.S. Provisional Application Ser. No. 60/796,451 filed on May 1, 2006 and entitled "Rid Based LED Cladding System with Obvious Nodes" in the name of Christopher Varrin, Nils Thoijussen, Matthew Ward, Jeremy Hochman, Jeff Maddox, and David Main. This application also claims benefit of U.S. Provisional Application Ser. No. 60/831,907 filed on Jul. 18, 2006 and entitled "Support and Connecting Structure for a Display System" in the name of Christopher Varrin and Jeff Maddox. The disclosures of these U.S. Provisional Applications are incorporated herein by reference in their entirety.

BACKGROUND OF DISCLOSURE

1. Field of the Disclosure

Embodiments disclosed herein generally relate to light emitting apparatuses and light emitting systems. More specifically, embodiments disclosed herein relate to an improved light emitting apparatus with pixels for use in various industries.

2. Background Art

Display units for entertainment, architectural, and advertising purposes have commonly been constructed of numbers of light emitting elements, such as light emitting diodes ("LEDs") or incandescent lamps mounted onto flat panels. These light emitting elements may be selectively turned on and off to create patterns, graphics, and video displays for both informational and aesthetic purposes. It is well known to construct these displays of tiles or large panels, each containing several light emitting elements, which may be assembled in position for an entertainment show or event, or as an architectural or advertising display. Examples of such systems are disclosed in U.S. Pat. Nos. 6,813,853, 6,704,989, 6,677,918, and 6,314,669.

As the LED video market expands into new domains, the classic fixed structure of the LED video panel may become a limitation. Designers, architects, and advertisers may desire the flexibility and versatility to use only one or a few products within the rapidly changing environment of the modem era. For example, a panel or modular box system may work well in a stadium score board or as an advertisement on the Las Vegas Strip, but the large panels may have limitations on transparency and weight.

As such, there may be a requirement at an event or within a theatrical production to use a display system that is easily removable, for example, in between scenes of a play or as the needs of the production may dictate. A display apparatus constructed as a large panel or as a series of solid tiles bolted or permanently fixed together may be very inappropriate for such an application or need. The displays may be large and heavy, and require abundant support machinery, time, and storage space for installation. For example, as disclosed in U.S. Pat. No. 6,704,989, issued to Lutz, an electronic signal display system requires the individual display sections be lifted out of storage cases with a lifting truss and then joined and stacked appropriately for display.

To improve upon these limitations, as described above, many existing products are being developed with a degree of transparency and to weigh less than their panel based counterparts. An example of such a prior art display apparatus is disclosed in U.S. Pat. No. 6,237,918, issued to Tokimoto, and incorporated by reference.

Referring to FIG. 1, an example of a prior art display apparatus 101 is shown. Display apparatus 101 includes two posts 103 at each end of display apparatus 101 with parallel and uniformly spaced beams 105 attached thereto. Each beam 105 then includes multiple pixels 107 disposed thereon with uniform spacing between each of beams 105.

However, several limitations may still prevent full usefulness of the prior art display apparatus. The display apparatus may still be overly cumbersome in weight. Next, the transparency of the apparatus may still be improved to decrease their visibility when not in use. Further, the rigging of the display apparatus may make it difficult assemble and/or disassemble the display system before and after use. Accordingly, there exists a need for a display apparatus and a display system that improves upon these prior art displays for continued development and success within the various light emitting industries.

SUMMARY OF INVENTION

In one aspect, embodiments disclosed herein relate to a light emitting apparatus. The light emitting apparatus includes a spine, a rib attached to the spine, and a connector configured to rotationally attach to another light emitting apparatus. The rib includes a plurality of nodes, each node having a pixel, and a plurality of connection links. The plurality of nodes alternate with the plurality of connection links to form the rib. Further, at least one of the plurality of connection links is thinner in cross-section than at least one of the plurality of nodes. Finally, the plurality of pixels are configured to receive a data signal and power.

In another aspect, embodiments disclosed herein relate to a system to display visual information. The system includes a first light emitting apparatus and a second light emitting apparatus, each having a plurality of pixels. A first connector and a second connector are attached to an edge of the first light emitting apparatus and the second light emitting apparatus, respectively. Further, the first connector and the second connector are configured to receive a support structure to connect the first and second light emitting apparatuses with one another.

In yet another aspect, embodiments disclosed herein relate to a method for displaying an image. The method includes providing a display apparatus, in which the display apparatus includes a rib attached to a spine, and a connector. The rib includes a plurality of nodes, each node having a pixel, and a plurality of connection links. The plurality of nodes alternate with the plurality of connection links to form the rib, and at least one of the plurality of connection links is thinner in cross-section than at least one of the plurality of nodes. The connector is configured to rotationally attach to another light emitting apparatus, and the plurality of pixels are configured to receive a data signal and power. The method further includes sending the data signal to the display apparatus, in which the plurality of pixels are further configured to display the image based on the data signal.

Other aspects and advantages of the invention will be apparent from the following description and the appended claims.

DETAILED DESCRIPTION

Figure 1:
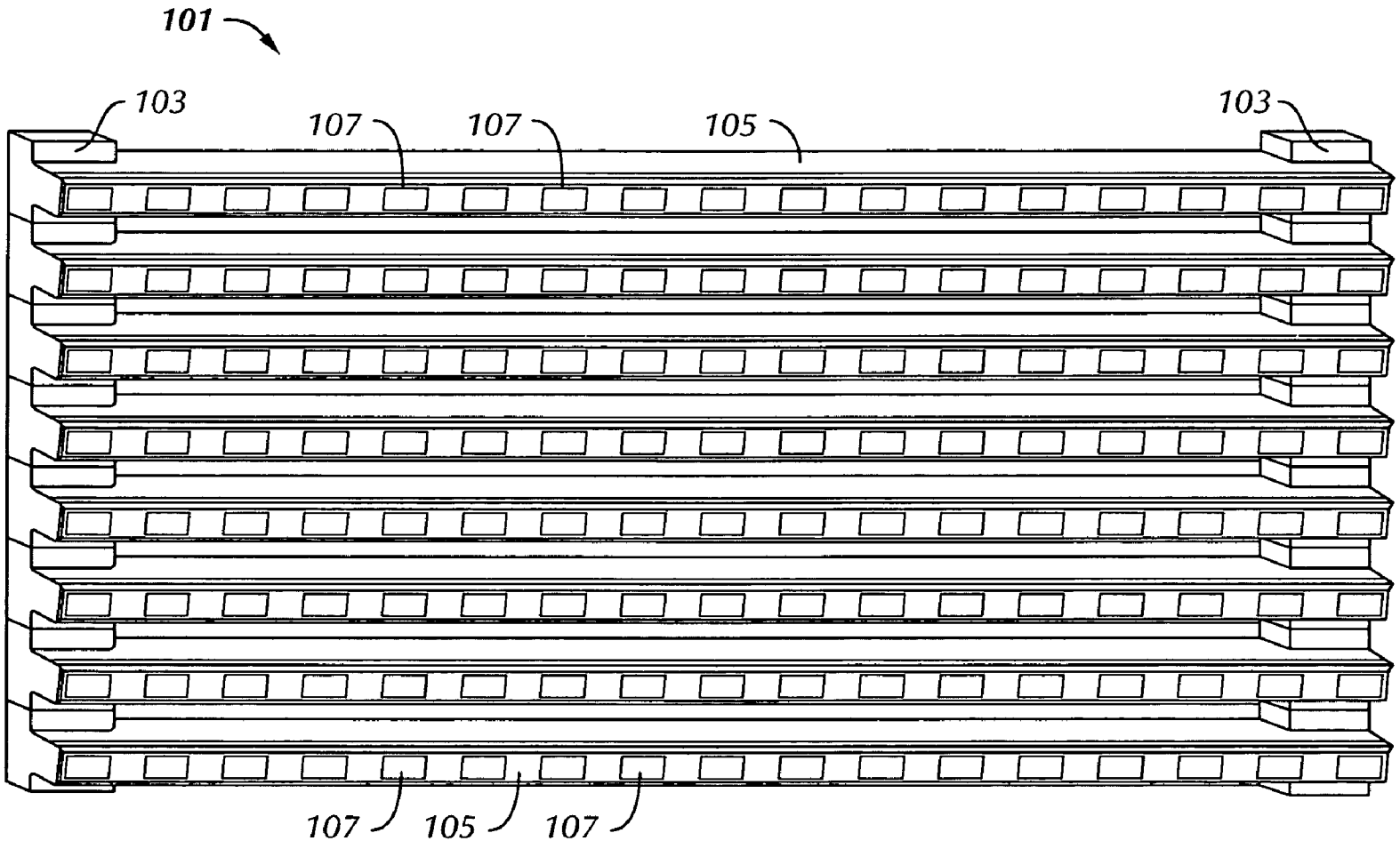
FIG. 1 (Prior Art)
FIG. 1 shows a view of a prior art display apparatus.

In one aspect, embodiments disclosed herein relate to a light emitting apparatus with increased transparency. The light emitting apparatus includes ribs, in which the ribs have thicker nodes interconnected by thinner links. In another aspect, embodiments disclosed herein relate to connectors disposed between light emitting apparatuses of a light emitting system. The connectors enable the light emitting apparatuses of the system to rotate with respect to one another as the light emitting apparatuses are interconnected within the system. Further, like elements in the various figures may be denoted by like reference numerals for consistency.

Figure 2:
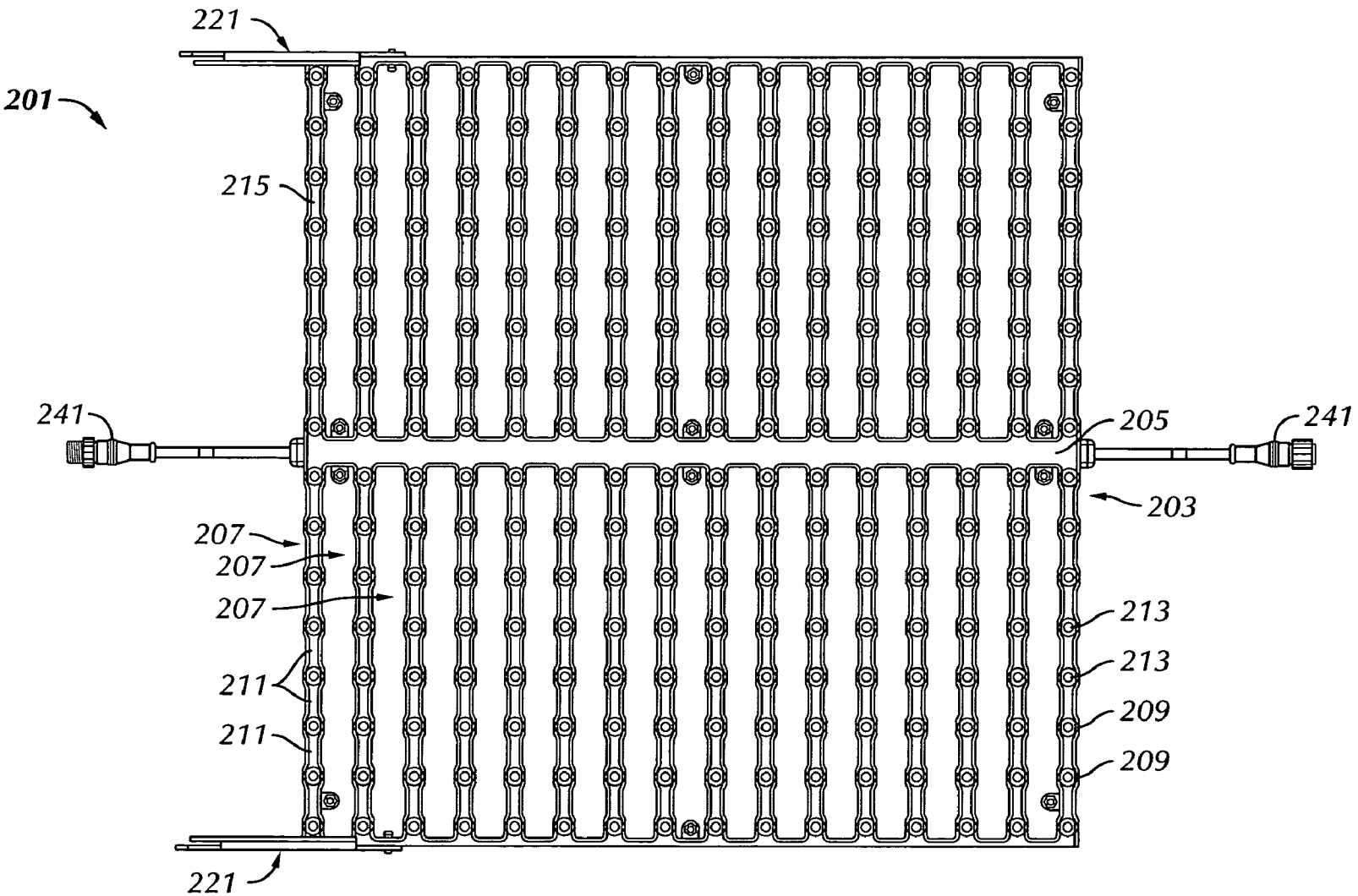
FIG. 2 shows a front perspective view of a light emitting apparatus in accordance with embodiments disclosed herein.

Referring to FIG. 2, a front perspective view of a light emitting apparatus 201 in accordance with embodiments disclosed herein is shown. Light emitting apparatus 201 includes a frame 203 having a spine 205 with ribs 207 attached thereto. Ribs 207 may be formed with spine 205, as shown, or ribs 205 may be removably attached to spine 205. Further, ribs 207 include nodes. 209 interconnected with connection links 211. Specifically, as shown, each of ribs 207 have nodes 209 and connection links 211, in which nodes 209 alternate with connection links 211 (e.g., a first node attaches to a first connection link, the first connection link attaches to a second node, the second node attaches to a second connection link, and so forth) to form ribs 207. Each of nodes 209 then may include pixels 213, such as disposed within nodes 209, to emit light. Thus, the light emitting apparatus may include multiple ribs attached to the spine, with each of the ribs including multiple pixels.

Light emitting apparatus 201 further includes electrical connectors 241 to supply a data signal and power to light emitting apparatus 201. Specifically, as shown, electrical connectors 241 may attach to spine 205 of light emitting apparatus 201 and electrically connect to pixels 213 to supply a data signal and power to control pixels 213. Electrical connectors 241 may electrically connect with adjacent light emitting apparatuses (not shown) or electrically connect to a source (not shown). Spine 205 and ribs 207 may then include cabling or circuit boards to electrically connect pixels 213 with electrical connectors 241 to transfer and supply the necessary data signals and power. As such, for pixels 213 to receive power, power received within electrical connectors 241 may be transmitted through spine 205 and through each of connection links 211 using a circuit board or electrical wires for each of pixels 213 within light emitting apparatus 201 to emit light.

Referring still to FIG. 2, frame 203 of light emitting apparatus 201 may include a front housing 215 and a back housing (not shown). Front housing 215 and back housing may provide structural rigidity and protection of pixels 213 and any electrical components disposed therein. For example, front housing 215 may have a U-shaped cross-section at the areas of spine 205 and ribs 207 with a back housing attached thereto. Thus, electrical wires and/or circuit boards to electrically connect pixels 213 to electrical connectors 241 and supply the data signals and power may be disposed with frame 203 for protection. Further, because the light emitting apparatus may be used in an outdoor environment, as well as an indoor environment, the light emitting apparatus may include seals to provide a weather-resistant or a weatherproof construction. For example, a seal, such as all-weather glue, may be disposed at some or all of the areas between the front housing and the back housing to prevent any fluid from entering or exiting the light emitting apparatus.

The light emitting apparatuses in accordance with embodiments disclosed herein increases transparency to enhance visibility through the light emitting apparatuses when not in use. As such, the connection links may be minimized in cross-sectional area to increase the transparency. For example, the connection links may have a thinner cross-section than the nodes. The pixels within the nodes may then be very apparent, visible, and bright when the light emitting apparatus is in use, but the thinner connection links will increase transparency when the light emitting apparatus is not in use. To further reduce the size and cross-section of the connection links, electrical wires may be used instead of a circuit board to electrically connect the pixels within the light emitting apparatus. However, if a circuit board is used, the circuit board within each of the connection links and/or the spine may be oriented perpendicular with respect to a plane of the ribs. With this orientation, the thinner side of the circuit board will be exposed to the visible path through the light emitting apparatus to reduce the necessary cross-sectional area of the connection links. Thus, a number of techniques may be used to reduce the cross-section of the connection links relative to the nodes, thereby enhancing the transparency of the light emitting apparatus.

Figure 3:
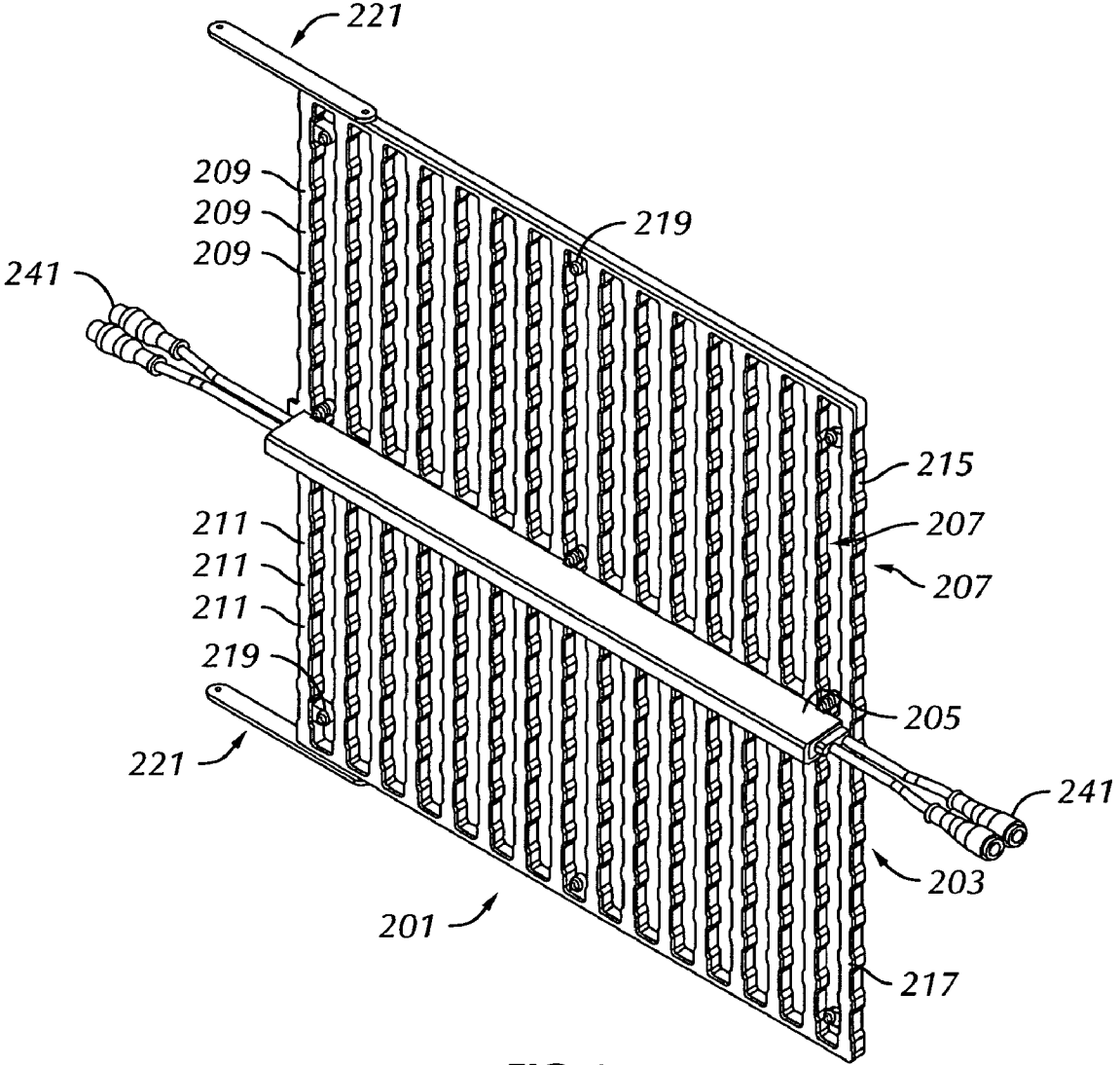
FIG. 3 shows a back perspective view of a light emitting apparatus in accordance with embodiments disclosed herein.

Referring now to FIG. 3, a back perspective view of light emitting apparatus 201 in accordance with embodiments disclosed herein is shown. As discussed above, light emitting apparatus 201 includes frame 203 having spine 205 with ribs 207 attached thereto. Frame 203 then may include a front housing 215 and a back housing 217. As shown, front housing 215 and back housing 217 may attach to one another using screws 219. However, those having ordinary skill in the art will appreciate that the invention is not so limited, and any securing mechanism known in the art, such as bolts or adhesive materials, may be used without departing from the scope of the present invention. Further, in this embodiment, as indicated by the shape of spine 205, spine 205 may include a circuit board disposed therein and oriented perpendicular to the plane of ribs 207. This orientation of the circuit board within spine 205 may increase the rigidity of light emitting apparatus 201, in addition to reducing the thickness and cross section of spine 205 to increase transparency of light emitting apparatus 201.

As shown in FIGS. 2 and 3, ribs 207 may be integrally formed with spine 205 within light emitting apparatus 201. However, those having ordinary skill in the art will appreciate that the invention is not so limited, and in other embodiments, the ribs may be removably secured to the spine of the light emitting apparatus. For example, the ribs may attach to the spine through an interference fit such that the ribs may "snap" on-and-off with the spine, thereby enabling the ribs to be removably attached to the spine. Further, also shown in FIGS. 2 and 3, connection links 211 may be integrally formed with nodes 209 to form ribs 207. However, those having ordinary skill in the art will appreciate that the invention is not so limited, and in other embodiments, the connection links and the nodes may also be removably secured to one another. For example, each of the connection links may attach to the nodes through an interference fit such that the connection links may snap on-and-off with nodes as appropriate. Enabling removable attachment of the ribs, the connection links, and the nodes would facilitate shaping the light emitting apparatus into, for example, letters, characters, or any other graphic designs.

Further, as described above, ribs 207 and spine 203 may be manufactured from a rigid material, such as having a rigid thicker plastic or metal. However, those having ordinary skill in the art will appreciate that the invention is not so limited, and in other embodiments, the ribs, the spine, and associated electrical wires and/or circuit boards may be manufactured from flexible materials. For example, using a thinner flexible plastic or metal to manufacture the ribs, the spine, and the associated wires and/or circuit boards, some or all of the components of the light emitting apparatus may be made flexible. As such, this would also facilitate shaping the light emitting apparatus into graphic designs.

Furthermore, those having ordinary skill in the art will appreciate that in the embodiments described herein, a pixel may include one or more light emitting elements. These light emitting elements may then include, for example, light emitting diodes (LEDs), organic LEDs (OLEDs), polymer LEDs (PLEDs), incandescent lamps, or any other lighting elements known in the art. Therefore, in one embodiment, a pixel may include a plurality of LEDs such that light of a desired color may be emitted from each pixel. For example, the pixel may include a red LED, a blue LED, and a green LED such that the intensity of each LED may be varied to produce a desired color, as is well known in the art. Further, those having ordinary skill in the art will appreciate that the pixels may be of any size and shape, such as square or circular, and the size and shape need not be uniform throughout the use in a system having multiple light emitting assemblies in accordance with embodiments disclosed herein. Furthermore, the pixels may also include driver circuits that vary the intensities of the lighting elements within the pixel.

Figure 4:
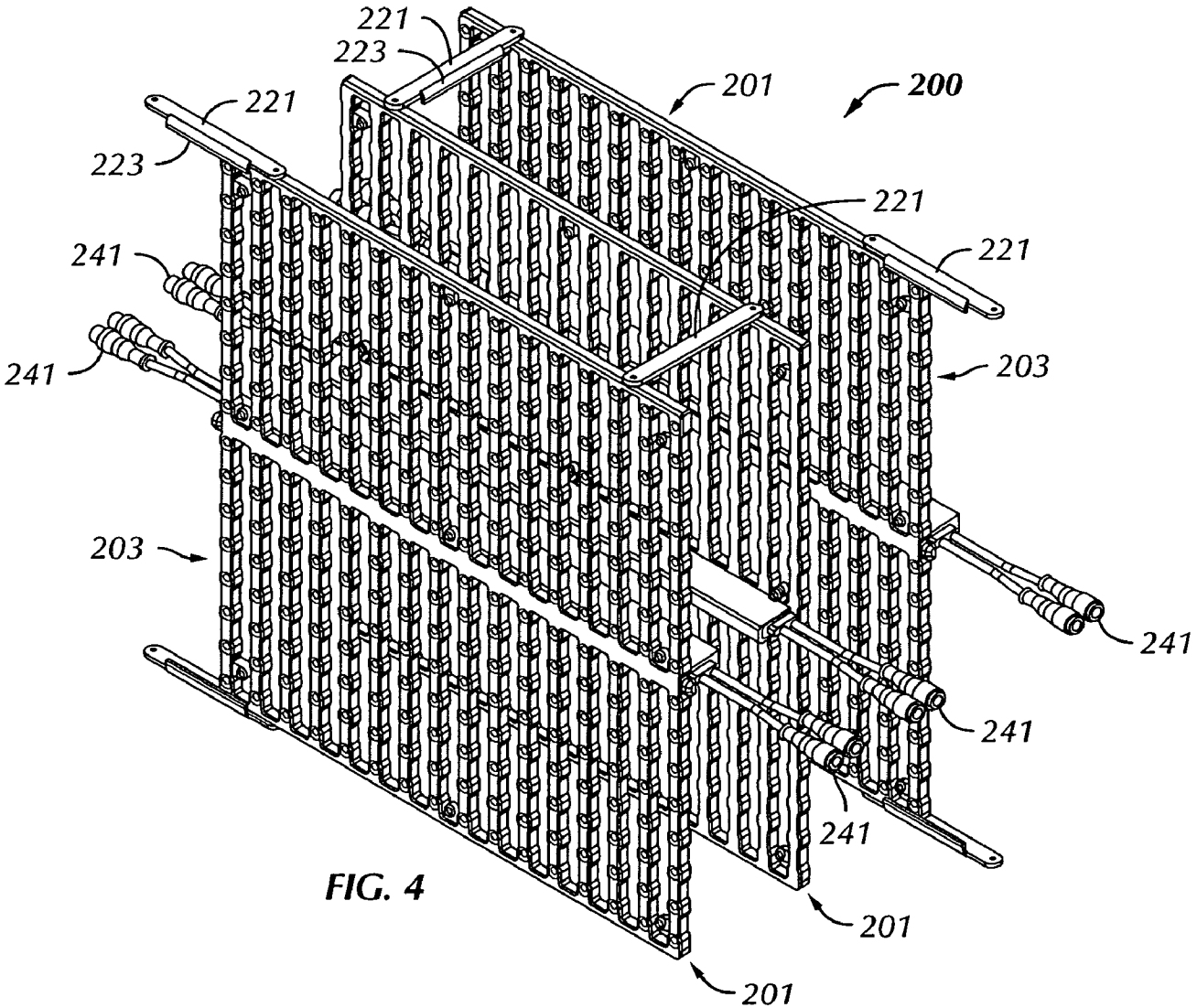
FIG. 4 shows a perspective view of a light emitting system in accordance with embodiments disclosed herein.

Referring now to FIG. 4, a perspective view of a light emitting system 200 having multiple light emitting apparatuses 201 in accordance with embodiments disclosed herein is shown. As shown in FIG. 4 (also shown in FIGS. 2 and 3), light emitting apparatuses 201 may include connectors 221 disposed thereon or attached thereto. In this embodiment, connectors 221 are configured to rotationally attach or connect one light emitting apparatus 201 to an adjacent light emitting apparatus 221. As such, one end of connectors 221 may attach to an edge of frame 203 of one light emitting apparatus 201, and the other end of connectors 221 may then attach to an edge of a frame 203 of adjacent light emitting apparatus 201.

Connectors 221 may then enable light emitting apparatuses 221 to rotate in alternating opposing directions, as shown in FIG. 4, to fold light emitting system 200 into a stacked arrangement. This arrangement of light emitting apparatuses 201 may minimize the overall size of light emitting system 200 to facilitate storage and installation of system 200. Connectors 221 may also contain prevention elements 223 to prevent rotation of light emitting apparatuses 201 in one direction, thereby only allowing rotation between adjacent light emitting apparatuses 201 with respect to one another in the other direction. These prevention mechanisms 227 may enable light emitting system 200 to form a rigid structure when light emitting system 200 is in a displayed arrangement and light emitting apparatuses 201 are arranged to form a single plane. Furthermore, when light emitting system 200 is in the stacked arrangement, connectors 221 may be used to form a rigid box structure between adjacent light emitting apparatuses 201. For example, connectors 221 between two adjacent light emitting apparatuses 221 may be connected therebetween such that a rigid box structure is formed with two adjacent light emitting apparatuses 221.

Figure 5:
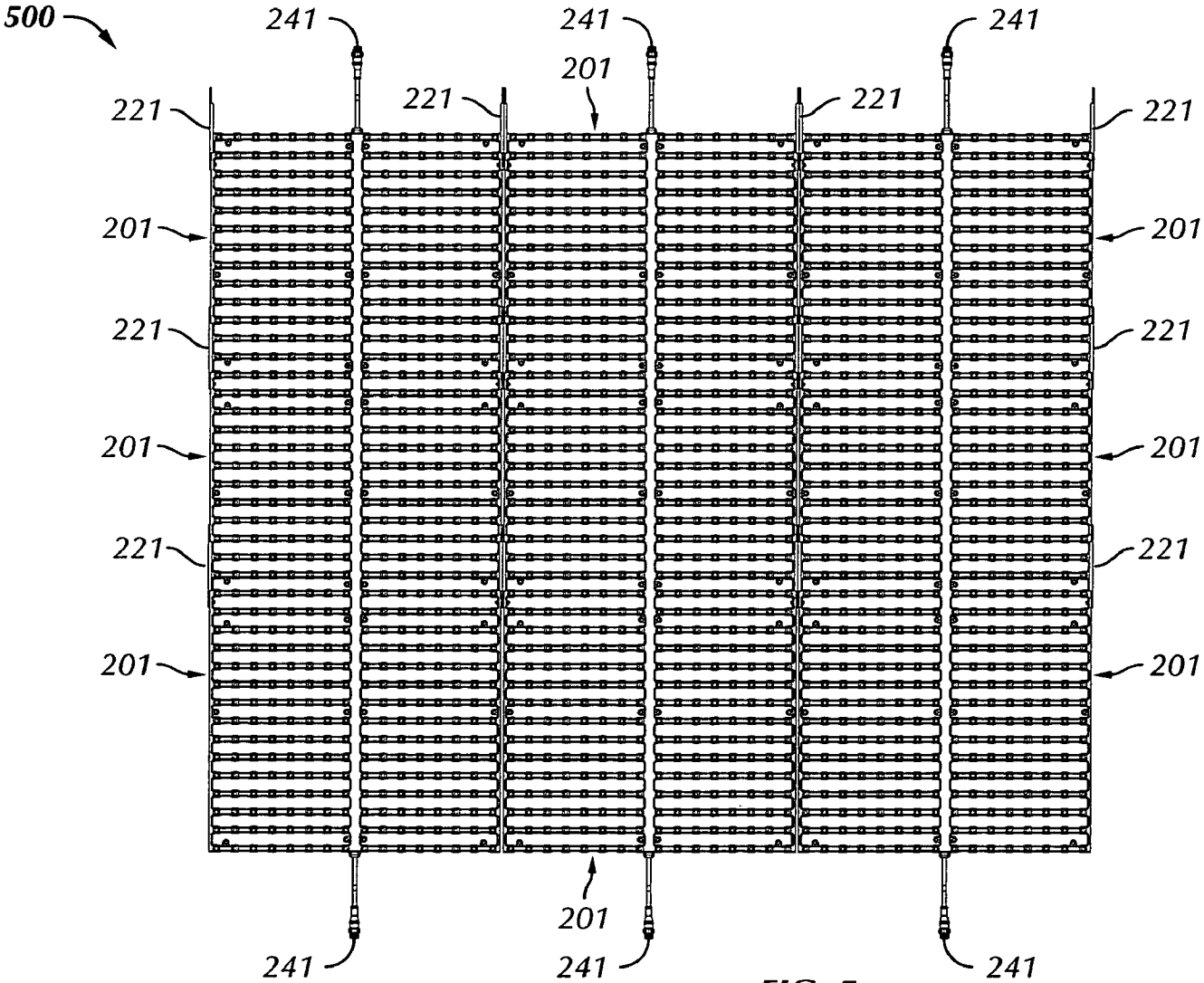
FIG. 5 shows another perspective view of a light emitting system in accordance with embodiments disclosed herein.

Referring now to FIG. 5, another perspective view of a light emitting system 500 having multiple light emitting apparatuses 201 in accordance with embodiments disclosed herein is shown. In this embodiment, light emitting system 500 includes nine light emitting apparatuses 201. System 500 is in a displayed arrangement such that light emitting apparatuses 201 are arranged to form a single plane. Further, FIG. 5 shows that connectors 221 may be used to connect adjacent light emitting apparatuses 201 to one another. Specifically, connectors 221 may be used to not only connect light emitting apparatuses 201 together vertically, but connectors 221 may also be used to connect light emitting apparatuses 201 together horizontally.

Figure 6:
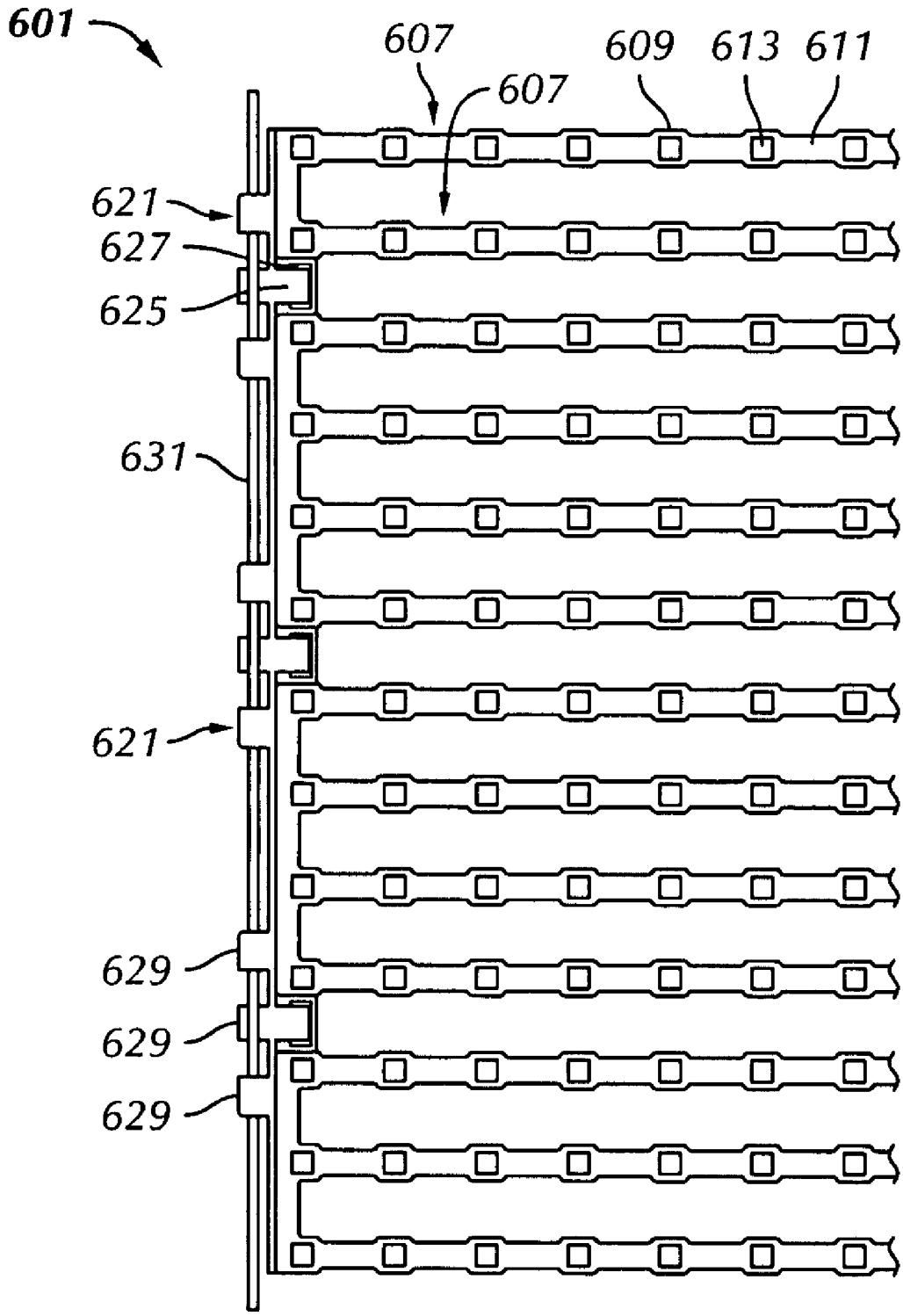
FIG. 6 shows an enlarged view of a light emitting apparatus having a connector in accordance with embodiments disclosed herein.

Referring now to FIG. 6, an enlarged view of a light emitting apparatus 601 having a connector 621 in accordance with embodiments disclosed herein is shown. As discussed above, light emitting apparatus 601 includes a frame 603 having ribs 607 and a spine (not shown). Each of ribs 607 includes multiple connection links 611 and nodes 609, in which pixels 613 that emit light are disposed within nodes 609. Further, as shown in this embodiment, connector 621 is attached to an edge of light emitting apparatus 601. Specifically, in this embodiment, connector 621 may be attached to light emitting apparatus through an interference fit. As shown, connector 621 may include a tab 625 that snaps into engagement with a hole 627 disposed within frame 603. Thus, through the removable engagement of tab 625 and hole 627, connector 621 may removably attach to the edge of light emitting apparatus 601.

Further, connector 621 may include fingers 629 attached thereto or disposed thereon. In this embodiment, fingers 629 are attached to connector 621 by integrally forming fingers 629 therewith. Fingers 629 of connector 621 are then configured to receive a support structure 631. The support structure may be a rigid rod, a flexible cable or wire, or any other similar support structure known in the art. Regardless, support structure 631 passes through fingers 629 such that connector 621 may rotate about and slide along support structure 631.

A light emitting system may then be formed having multiple light emitting apparatuses. Each of the light emitting apparatuses may include a connector attached to an edge as shown in FIG. 6. A support structure may then pass through each of the connectors of the light emitting apparatuses, thereby forming the light emitting system. As such, because the connectors may removably attach to each of the light emitting apparatuses, each of the light emitting apparatuses may be removed or replaced from the light emitting system while each of the connectors stay engaged with the support structure. For example, light emitting apparatus 601 may be removed or replaced while connector 621 stays engaged with support structure 631 because connector 621 may removably engage light emitting apparatus 601.

Further, if the support structure is a rigid structure, such as a rigid rod, the rigid rod may pass through the fingers of the connector from one of the ends of the connector. However, as shown, the fingers of the connector may have a "U-shaped" design to only partially encompass or surround the support structure. In such an embodiment, if the support structure is a flexible cable, such as a metal cable, the fingers of the connector may be placed around the support structure in any particular order without requiring the support structure to be installed first at one of the ends of the connector. This U-shape design of the fingers, therefore, may enable installation or removal of the connector from the support structure without requiring the support structure to pass through all of the fingers. As such, in a light emitting system having multiple light emitting apparatuses with connectors receiving a single support structure, one of the connectors may be removed from the system without having to remove adjacent connectors.

Figure 7:
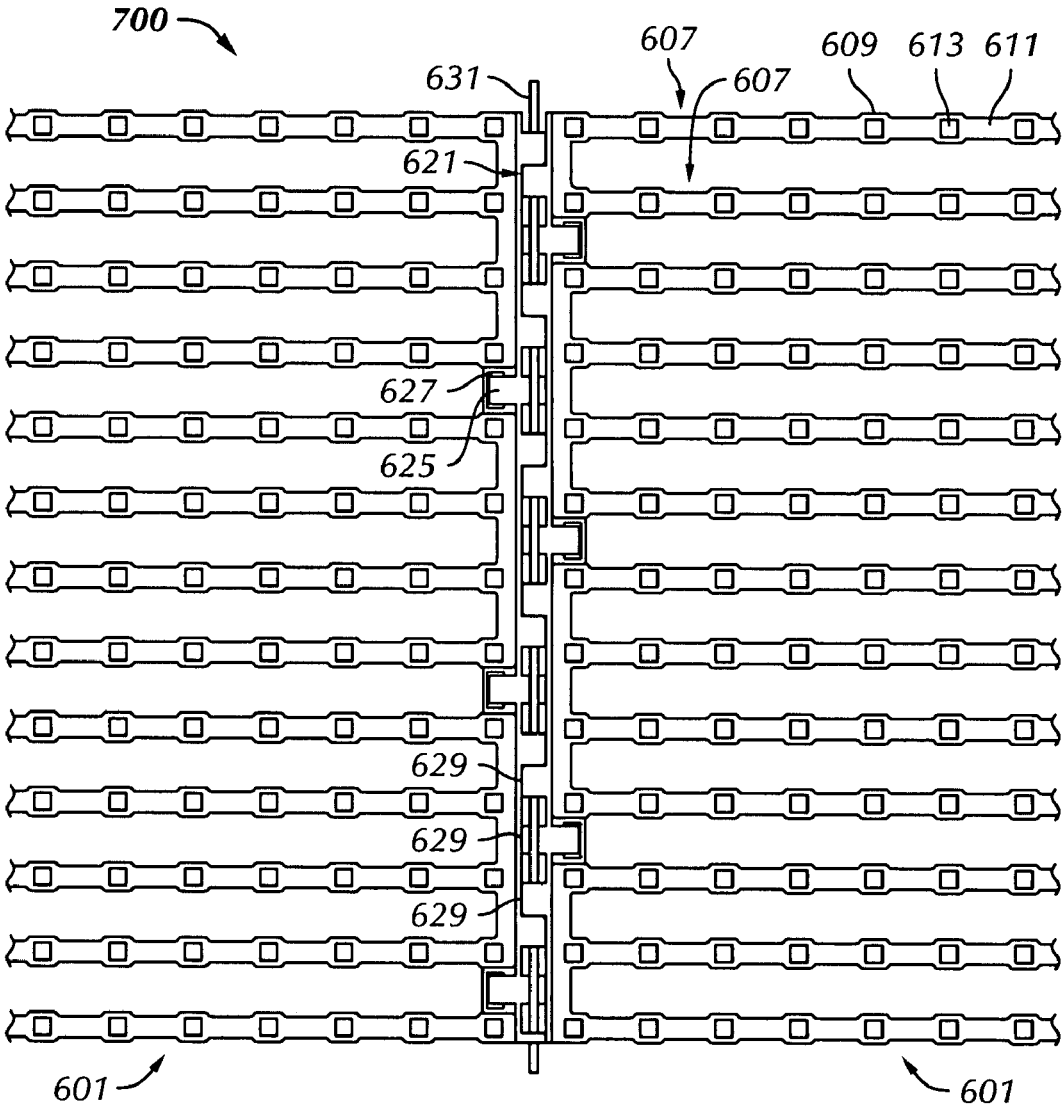
FIG. 7 shows an enlarged view of a light emitting system having multiple light emitting apparatuses in accordance with embodiments disclosed herein.

Referring now to FIG. 7, an enlarged view of a light emitting system 700 having multiple light emitting apparatuses 601 in accordance with embodiments disclosed herein is shown. In this embodiment, light emitting system 700 includes two light emitting apparatuses 601, each having a connector 621 with fingers 629. Connectors 621 may be removably attached to light emitting apparatuses 601 through tabs 625 of connectors 621 removably engaging holes 627 of light emitting apparatus 601. Further, as shown, multiple connectors 621 may engage support structure 631. Specifically, in this embodiment, fingers 629 of connectors 621 interleave such that a single continuous support structure 631 may be used to assemble light emitting system 700 with adjacent light emitting apparatuses 601.

Figure 8:
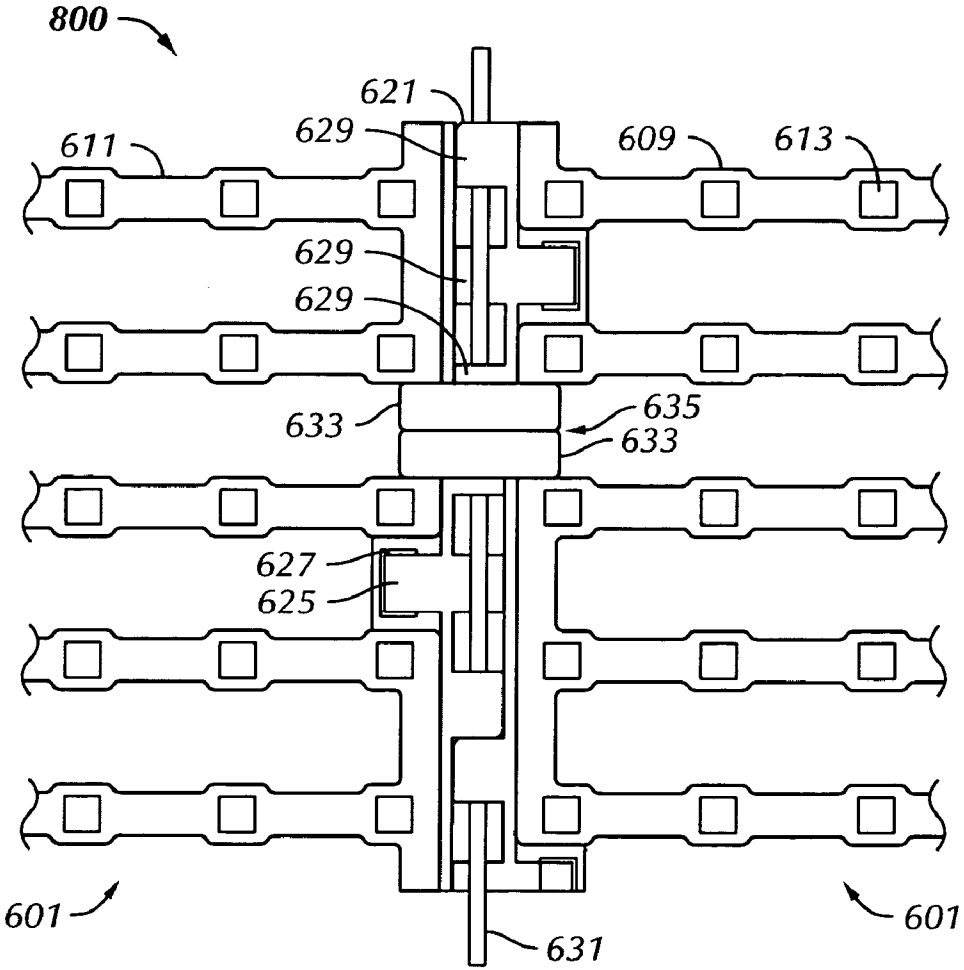
FIG. 8 shows another enlarged view of a light emitting system having multiple light emitting apparatuses in accordance with embodiments disclosed herein.

Referring now to FIG. 8, an enlarged view of a light emitting system 800 having multiple light emitting apparatuses 601 in accordance with embodiments disclosed herein is shown. In this embodiment, light emitting system 800 includes four light emitting apparatuses 601, each light emitting apparatus 601 including a connector 621 with fingers 629. Each of connectors 621 then engage support structure 631 to secure light emitting apparatuses 601 to support structure 631 and form light emitting system 800.

Further, connectors 621 may include alignment nubs 633 disposed at one or more of the ends of connectors 621. Similar to connectors 621, alignment nubs 633 may be able to rotate about and slide along support structure 631. As shown, alignment nubs 633 of adjacent connectors 621 may contact at a contact point 635. This contact point 635 between adjacent alignment nubs 633 may facilitate accurate alignment between light emitting apparatuses 601 of light emitting system 800. In one embodiment, if light emitting system 800 is oriented vertically, the force of gravity pushing down on light emitting apparatuses 601 may provide sufficient force to enable contact between alignment nubs 633 at contact point 635. In another embodiment, if light emitting system 800 is oriented at other angles, then pressure may be provided by a spring or other pressure systems known in the art to light emitting apparatuses 601 to enable contact at contact point 635 between alignment nubs 633.

Figure 9:
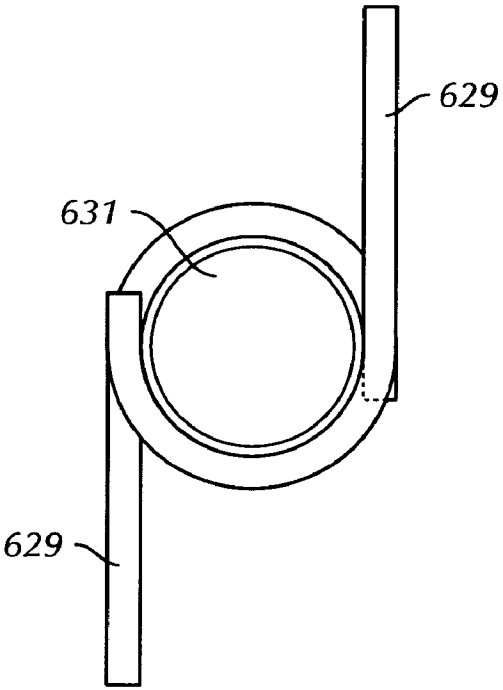
FIG. 9 shows an enlarged elevation view of fingers and a support structure in accordance with embodiments disclosed herein.

Referring now to FIG. 9, an enlarged elevation view of fingers 629 and a support structure 631 in accordance with embodiments disclosed herein is shown. As shown and discussed above, fingers 629 of connectors 621 (shown in FIGS. 6-8) may have a "U-shaped" design. With a U-shaped design, fingers 629 may only partially encompass or surround support structure 631. Thus, if support structure 631 is a flexible support structure, fingers 629 may be removably attached to support structure 631 without requiring support structure 631 to pass through all of fingers 629 at one end. However, those having ordinary skill in the art will appreciate that the invention is not so limited, and the fingers of the connectors may fully encompass or surround to the support structure when attaching the light emitting apparatuses thereto.

Embodiments of the present disclosure may provide for one or more of the following advantages. First, embodiments disclosed herein may provide for a light emitting apparatus having increased transparency. With decreased cross-section of the connection links, the light emitting apparatus may increase transparency, especially when not in use. Further, embodiments disclosed herein may provide for a light emitting apparatus having a decreased weight. By eliminating any excess material of a light emitting apparatus, the light emitting apparatus becomes lighter, which facilitates installation. Finally, embodiments disclosed herein may provide for a light emitting apparatus and a light emitting system that has a rigid structure. With a rigid structure, the light emitting apparatus may provide protection and support for the light emitting system to manage larger loads and stresses.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for displaying an image, the method comprising:

providing a display apparatus, wherein the display apparatus comprises:

a rib attached to a spine, wherein the rib comprises:

a plurality of nodes, each node comprising a pixel; and a plurality of connection links;

wherein the plurality of nodes alternate with the plurality of connection links to form the rib; and wherein at least one of the plurality of connection links is thinner in cross-section than at least one of the plurality of nodes; and a connector configured to rotationally attach to another light emitting apparatus;

wherein the plurality of pixels are configured to receive a data signal and power; and sending the data signal to the display apparatus, wherein the plurality of pixels are further configured to display the image based on the data signal.

2. A light emitting apparatus, comprising:

a spine;

a rib attached to the spine, wherein the rib comprises:

a plurality of nodes, each node comprising a pixel; and a plurality of connection links;

wherein the plurality of nodes alternate with the plurality of connection links to form the rib; and wherein at least one of the plurality of connection links is thinner in cross-section than at least one of the plurality of nodes; and a connector configured to rotationally attach to another light emitting apparatus;

wherein the plurality of pixels are configured to receive a data signal and power.

3. The light emitting apparatus of claim 2, further comprising:

a frame, wherein the frame comprises the spine and the rib;

a circuit board disposed within the frame, wherein at least one of the plurality of pixels is disposed upon and electrically connected to the circuit board.

4. The light emitting apparatus of claim 3, wherein the frame further comprises:

a front housing; and a back housing configured to connect to the front housing;

wherein the circuit board is disposed between the front housing and the back housing.

5. The light emitting apparatus of claim 4, wherein the rib comprises a plurality of ribs, wherein each of the plurality of ribs is attached to the spine such that the ribs are aligned substantially parallel with one another and form a plane, wherein the circuit board is oriented perpendicular with respect to the plane within the frame.

6. The light emitting apparatus of claim 2, wherein each of the plurality of connection links is thinner than each of the plurality of nodes.

7. The light emitting apparatus of claim 2, wherein the connector comprises a hinge to rotationally attach to another apparatus.

8. The light emitting apparatus of claim 2, wherein the connector attaches to an edge of the light emitting apparatus.

9. The light emitting apparatus of claim 2, wherein the connector is configured to receive a support structure to attach to another light emitting apparatus.

10. The light emitting apparatus of claim 9, wherein the connector comprises fingers to receive the support structure.

11. The light emitting apparatus of claim 10, wherein the connector is configured to rotationally engage the support structure.

12. The light emitting apparatus of claim 2, wherein the plurality of pixels each comprise at least one light emitting elements selected from the group consisting of: a light emitting diode (LED), an organic light emitting diode (OLED), a polymer light emitting diode (PLED), and an incandescent lamp.

13. The light emitting apparatus of claim 2, wherein the plurality of pixels comprise a red LED, a green LEDD, and a blue LED.

14. The light emitting apparatus of claim 2, further comprising:

electrical connectors attached to the spine and electrically connected to the plurality of pixels to supply the data signal and power.

15. A system comprising a plurality of light emitting apparatuses as recited in claim 2.

* * * * *